United States Patent [19]

Raab et al.

[11] Patent Number: 4,718,342

[45] Date of Patent: Jan. 12, 1988

[54] RESILIENT SHEET GRIPPER FOR A SHEET-FED ROTARY PRINTING PRESS

[75] Inventors: Rudolf Raab, Hanau; Manfred Herold, Kahl/Main; Peter Hummel, Offenbach am Main, all of Fed. Rep. of Germany

[73] Assignee: M.A.N.-Roland Druckmaschinen Aktiengesellschaft, Fed. Rep. of Germany

[21] Appl. No.: 893,488

[22] Filed: Aug. 5, 1986

[30] Foreign Application Priority Data

Aug. 19, 1985 [DE] Fed. Rep. of Germany ..... 3529639

[51] Int. Cl.[4] ..... B41F 1/30

[52] U.S. Cl. ..... 101/409; 101/383; 101/368; 101/415.1; 101/246

[58] Field of Search ..... 101/415.1, 368, 382 R, 101/383, 384, 246, 409, 410, 411

[56] References Cited

U.S. PATENT DOCUMENTS

| | | | |
|---|---|---|---|
| 2,088,862 | 8/1937 | Lang | 101/409 |
| 3,007,408 | 11/1961 | Taylor et al. | 101/415.1 X |
| 3,424,085 | 1/1969 | Beisel | 101/415.1 |
| 3,536,321 | 10/1970 | Straube | 101/409 X |
| 3,637,202 | 1/1972 | Mowry et al. | 101/409 X |
| 3,650,211 | 3/1972 | Neutwich | 101/409 |
| 3,926,118 | 12/1975 | Preuss | 101/415.1 X |
| 3,994,224 | 11/1976 | Hill | 101/415.1 |
| 4,130,058 | 12/1978 | Bock | 101/415.1 |
| 4,183,299 | 1/1980 | Cappel | 101/415.1 |
| 4,253,396 | 3/1981 | Wieland | 101/246 X |
| 4,372,209 | 2/1983 | Jentzsch et al. | 101/409 |
| 4,466,350 | 8/1984 | Schilling | 101/410 |
| 4,502,388 | 3/1985 | Ishii | 101/415.1 |
| 4,527,478 | 7/1985 | Oifflipp et al. | 101/415.1 |

*Primary Examiner*—Charles A. Pearson
*Assistant Examiner*—James R. McDaniel
*Attorney, Agent, or Firm*—Leydig, Voit & Mayer

[57] ABSTRACT

A resilient sheet gripper for a sheet-fed rotary printing press having a gripper shaft to which is secured a pivoting clamping member in resilient relationship with a pivoted gripper finger having adjustable biasing provided by compression spring means, is provided including an adjusting screw mounted in a stop strip, an abutment for contacting the screw mounted for movement around the gripper shaft, a guide pin fixed to the abutment and disposed in a biased conical sleeve in the gripper finger so that the finger can move perpendicular to a gripper support upon closure of the gripper finger.

3 Claims, 6 Drawing Figures

A — A

RESILIENT SHEET GRIPPER FOR A SHEET-FED ROTARY PRINTING PRESS

FIELD OF THE INVENTION

The present invention relates generally to a sheet gripper for a sheet-fed rotary printing press and more particularly concerns such a gripper having a resilient gripper finger.

BACKGROUND OF THE INVENTION

Resilient sheet grippers are widely used in printing presses to non-positively grip a sheet of paper and hold it up against a cylinder. If the paper is pulled out of the gripper even slightly, problems arise with mackling and registration errors occur. Therefore, the gripper typically is required to have a very considerable retaining force, which usually means that the gripper springs must have a very high spring constant. Also, since any play present at the gripper tip would result in registration errors and mackling, it is desirable to minimize the bearing clearances of the gripper elements. The reduced bearing clearance, however, leads to increased friction in the gripper bearings so that some of the spring force operative for gripping is consumed in the bearing itself. The need further arises for the gripper shaft bearings to be very stable in order to reduce deformation associated with the abrupt closure of the grippers. A disadvantage of this is that very high mass forces are produced.

In short, the known gripper systems require very considerable forces for their actuation and only some of such forces can be used for sheet retention. Such substantial and abrupt forces may also cause unwanted oscillations of the press.

A gripper system of this general kind is shown in DD-PS No. 66 634 wherein a one-piece gripper lever is supported on a gripper shaft and adjustable biasing is provided by two compression springs. A disadvantage of this known system is that the gripper lever loses its statically determined position when the fullest possible compensation for the bearing force is required. At very high press speeds and high biasing forces, centering becomes inadequate, for example, as a result of disturbing vibrations introduced into the press. Other disadvantages are the relatively large inertia radius and the mass of the swinging parts.

Another known gripper system is disclosed in DE-OS No. 1 908 181 wherein the spindle of the gripper finger pivot is pivotally disposed parallel to the gripper shaft, the spindle of the gripper finger pivot being disposed substantially on the prolongation of a straight line connecting the support surface for the gripper tip to the gripper shaft axis. As is apparent from the geometry shown therein in FIG. 1, the force which the gripper tip applies to the gripper support also has a component in the direction of sheet movement. The sheet may therefore move for this reason and because of possible twisting of the gripper shaft at high biasings, even though there may be some improvement as compared with conventional grippers in which there is an arcuate motion around the gripper shaft axis.

The gripper disclosed in DD-PS No. 67 992 is mounted by means of a clamping member on a pivotable gripper shaft having a stationary axis. A gripper tongue makes a circular movement around such axis in a first movement phase and makes a movement substantially perpendicular to the gripper support in a second movement phase. This gripper, however, uses a nonpositive parallel spring strip arrangement and a gripper tongue which cannot withstand substantial closing forces without buckling. The gripper is therefore completely unsuitable for use with very high closing forces.

Gripper systems of the type disclosed in DE-PS No. 2 030 040 utilize a perpendicularly closing gripper with a controlled gripper shaft. A disadvantage of this known system is that the nonpositive actuation of the gripper shaft relative to the fulcrum of an actuating lever is by means of a guide on a control cam. The additional components associated with the control cam lead to increased mass forces of the system. The components also oscillate with substantial radii of inertia, leading to a reduction in press performance. Also, if dirt accumulation on the cam is fairly heavy, accurate guidance of the gripper movement phases is impossible.

The gripper system shown in DE-OS No. 3 130 689 uses a soft gripper support along with a gripper finger which has a flat gripper flight path and which closes perpendicularly in the final movement phase. There is a resilient abutment screw disposed in the gripper finger and operative against the sheet gripper stop. A further adjusting screw is needed to adjust the resiliently interconnected holders by which the gripper finger is associated with the gripper shaft. A disadvantage of this type of gripper is that the gripper finger must be associated with a soft gripper support and complicated adjustment must be made by means of two adjusting screws to ensure accurate operation. Furthermore, the gripping action becomes uncertain at high press speeds.

OBJECTS AND SUMMARY OF THE INVENTION

It is a primary object of the present invention to provide a gripper of the kind hereinbefore set out wherein the closing gripper finger has a second movement phase characterized by a positive movement substantially perpendicular to the gripper support. It is a more particular object to impart such movement by means of a rectilinear guide.

This is accomplished, according to the invention, by a gripper having a gripper shaft to which is secured a pivoting clamping member in resilient relationship with a pivoted gripper finger having adjustable biasing provided by two compression springs, wherein an adjusting screw mounted in a stop strip is positioned to be contacted by an abutment slidably mounted to the gripper shaft, the abutment having a guide pin fixed thereto and disposed in a biased conical sleeve in the gripper finger so that the finger can move perpendicular to a gripper support upon closure of the gripper finger when the abutment is contacting the screw.

The primary advantages of the sheet gripper of the present invention are that, without any bending of the gripper tip and independent of soiling of the guide and of a soft gripper support, over a wide range of speeds, at elevated biasing forces, and with positive pressures in the direction of sheet movement, disturbing forces and vibrations have no adverse effect on press performance. Moreover, sheet retention is improved by accurate rectilinear guidance of the perpendicular closing step, the gripper finger always remaining in its statically determined position and reacting less sluggishly.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
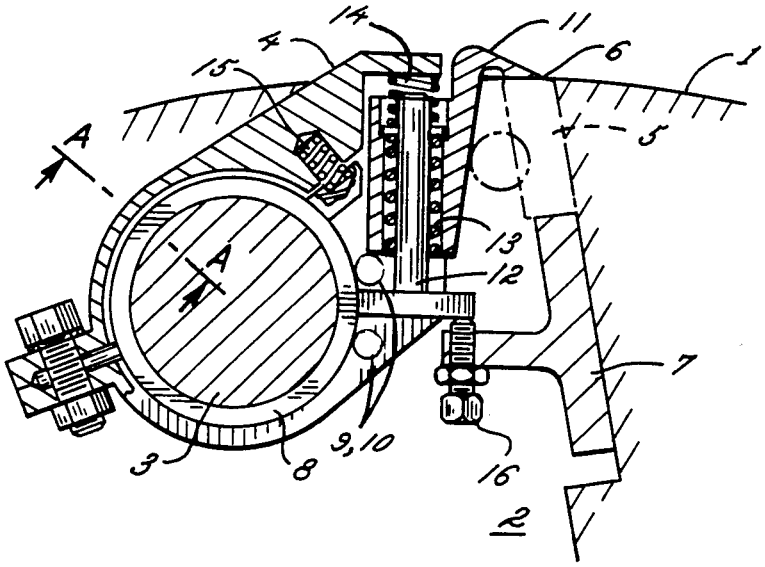
FIG. 1 is a side elevation view, partly in section, of the gripper of the present invention.
Figure 2:
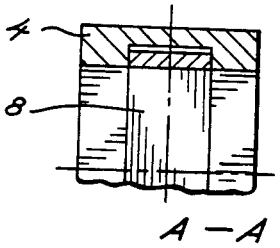
FIG. 2 is a section on the line A—A of FIG. 1.
Figure 3:
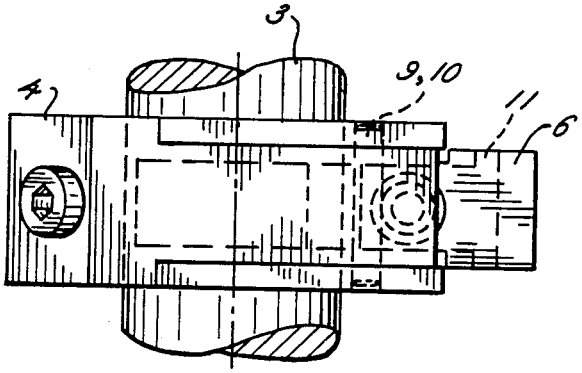
FIG. 3 is a plan view of the gripper of FIG. 1.

Turning now to the drawings, FIG. 1 shows the construction of the gripper of the present invention wherein a cylinder 1 is formed with a groove 2 in which a gripper shaft 3 is mounted with its axis stationary. A clamping member 4 is clamped on the shaft 3. A gripper support 5 is secured to a wall of the grove 2 and a support surface 6 of support 5 is at the same height as the peripheral surface of the cylinder 1. A strip 7 is also secured to the groove wall and carries an adjusting screw 16 serving as a stop for an abutment 8. The abutment 8 is slidably mounted on the gripper shaft 3, its movement being axially limited by the clamping member 4 as shown in FIG. 2, and rotationally limited by cylindrical pins 9, 10 on the member 4. A biased gripper finger 11 having a conical sleeve 13 is mounted resiliently by way of compression springs 14, 15 for longitudinal movement on a guide pin 12 which is secured to the abutment 8 and is received in the conical sleeve 13.

Pursuant to the invention, the gripper finger 11 in this arrangement closes perpendicularly without backlash. Furthermore, the retaining surface of the finger 11, being maintained parallel to the support surface 6 against rotation of the member 4 upon closure of the finger 11, can be given a basic setting parallel to the gripper support surface 6 by means of an adjusting screw 16. Preferably, the gripper finger 11 is given additional guidance by means of a support roller 17, being adjustable by an eccentric mounting, in order to maintain the statically determined position of the gripper finger 11 despite even very severe bending stresses.

Figure 4:
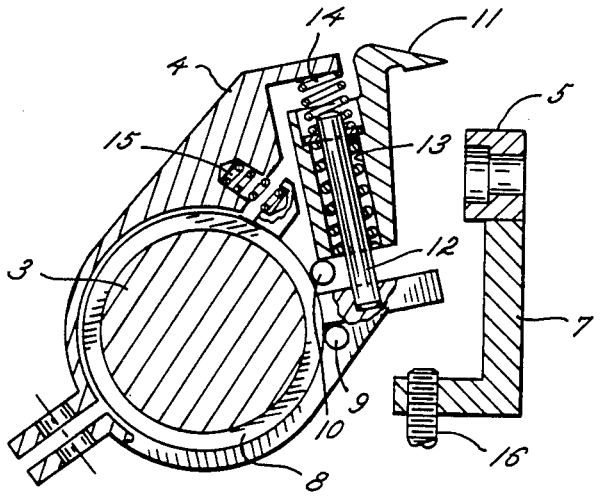
FIG. 4 is a diagrammatic view showing the gripper of FIG. 1 in open position.
Figure 5:
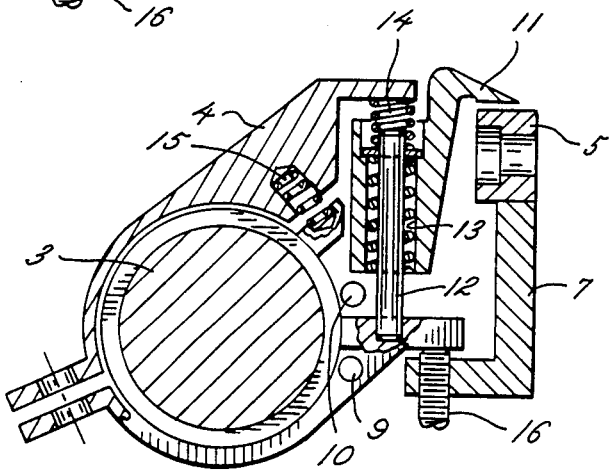
FIG. 5 is similar to FIG. 4, but showing the gripper upon completion of the first movement phase during perpendicular closing movement, at a gripper tip opening of approximately 1 mm.
Figure 6:
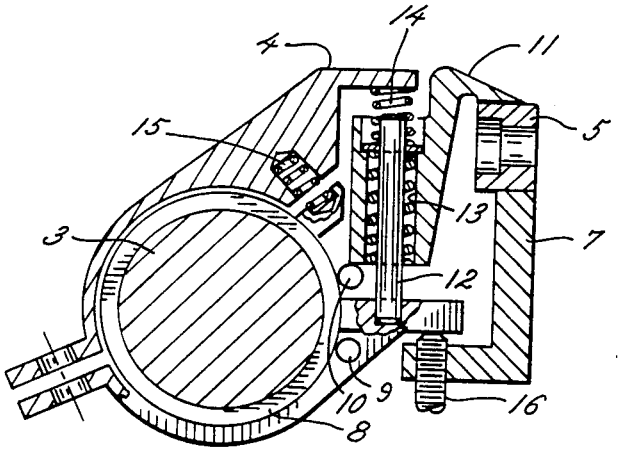
FIG. 6 is similar to FIG. 4, but showing the gripper closed.

FIGS. 4–6 are diagrammatic views of the gripper in three different positions. FIG. 4 shows the gripper in the open position, where the cylindrical pin 9 of the clamping member 4 is in contact with the abutment 8, such contact being maintained by the compression spring 15. Similarly, the cylindrical pin 10 is then in contact with the gripper finger 11, holding the finger 11 in the open position, such contact being maintained by the compression spring 14. In practicing the invention, when the shaft 3 rotates as it moves from the open position of FIG. 4, the abutment 8 initially abuts the screw 16 in the strip 7 with the gripper tip still being open about 1 mm.

With the abutment 8 contacting the screw 16, the finger 11, in a second movement phase, then moves on the guide pin 12 of the abutment 8 lengthwise and without backlash and perpendicular to the support 5 until the gripper is fully closed, the pins 9, 10 then no longer being in contact with the abutment 8 and the finger 11 respectively. The gripper in the closed position is shown in FIG. 5 gripping a sheet of paper 18 having a thickness of 1 mm, and in FIG. 6 fully closed without a sheet of paper.

From the foregoing, it will be appreciated that the sheet gripper of the present invention provides accurate sheet transfer between the cylinder 1 and some other cylinder or drum, the finger 11 being guided perpendicularly in the final movement phase with great stability and accuracy. Consequently, since the closing operation is free from sliding and the retention is improved, neither disturbing forces nor vibrations can affect the sheet movement. Tolerances and the otherwise present torsion of the gripper shaft 3 likewise do not impair the closing forces. In addition, the compact size of the gripper enables it to function without projecting too far from the periphery of the cylinder 1 and further allows the groove 2 to be relatively narrow. Also, since the gripper shaft 3 can be mounted substantially below the gripper support 5, the sheet front edge can move freely with a very small pivot angle.

We claim as our invention:

1. A sheet gripper assembly for use in a press cylinder of a sheet-fed rotary printing press comprising,
   - a gripper shaft mounted on said cylinder for relative rotational movement,
   - a gripper support on said cylinder,
   - a clamping member fixed to said gripper shaft,
   - an abutment member mounted on said gripper shaft for rotational and axial movement relative to said gripper shaft,
   - said abutment member having a guide pin,
   - a gripper finger having a sleeve portion mounted on said abutment member guide pin for relative sliding movement,
   - said gripper finger having a tip and being pivotable upon rotational movement of said gripper shaft from an open position to a sheet engaging position whereby said tip cooperates with said gripper support for engaging a sheet therebetween, and
   - means fixed to said cylinder for supporting an axially positionable stop screw against which said abutment member is engagable upon pivoting of said gripper finger toward said sheet engaging position whereupon said gripper shaft is rotatable relative to said abutment member and said gripper finger is moveable relative to said abutment member pin toward said sheet engaging position in a path substantially perpendicular to said support surface.

2. A sheet gripper assembly according to claim 1, further comprising an adjustable support roller mounted on the gripper support for further guiding the gripper finger.

3. The sheet gripper assembly of claim 1 including a pair of pins fixed to said clamping member in circumferentially spaced relation about said abutment member for limiting rotational movement of said abutment member relative to said gripper shaft, and said clamping member further including means for limiting axial movement of said abutment member relative to said gripper shaft.

* * * * *